United States Patent [19]

Kind

[11] Patent Number: 4,903,898

[45] Date of Patent: Feb. 27, 1990

[54] FUEL INJECTION VALVE

[75] Inventor: Wilhelm Kind, Bamberg, Fed. Rep. of Germany

[73] Assignee: Robert Bosch GmbH, Stuttgart, Fed. Rep. of Germany

[21] Appl. No.: 310,025

[22] Filed: Feb. 10, 1989

Related U.S. Application Data

[63] Continuation of Ser. No. 124,526, Nov. 24, 1987, abandoned.

[30] Foreign Application Priority Data

Nov. 28, 1986 [DE] Fed. Rep. of Germany ... 8632002[U]

[51] Int. Cl.[4] ..... F02M 61/12

[52] U.S. Cl. ..... 239/533.12; 239/585

[58] Field of Search ..... 239/584, 585, 533.3–533.12; 251/129.15

[56] References Cited

U.S. PATENT DOCUMENTS

| | | | |
|---|---|---|---|
| 4,230,273 | 10/1980 | Claxton et al. | 239/585 |
| 4,266,729 | 5/1981 | Kulke et al. | 239/585 |
| 4,509,693 | 4/1985 | Nakai | 239/585 |
| 4,621,772 | 11/1986 | Blythe et al. | 239/585 |
| 4,625,919 | 12/1986 | Soma et al. | 239/585 |
| 4,637,554 | 1/1987 | Takeda | 239/585 |
| 4,646,974 | 3/1987 | Sofianek et al. | 239/585 |
| 4,699,323 | 10/1987 | Rush et al. | 239/585 |

FOREIGN PATENT DOCUMENTS 2343243 5/1974 Fed. Rep. of Germany ..... 239/585

*Primary Examiner*—Andres Kashnikow
*Assistant Examiner*—M. Forman
*Attorney, Agent, or Firm*—Edwin E. Greigg

[57] ABSTRACT

A fuel injection valve which is used to inject fuel into the intake tube of a mixture compressing internal combustion engine having externally supplied ignition. The fuel injection valve includes a nozzle body, in which a valve seat face is embodied. Cooperating with the valve seat face is a valve needle on which an armature that is electromagnetically actuated by a magnet coil is secured. The valve needle has a first guide section and a second guide section. A flat plate is disposed downstream of the valve seat face and four bores spaced apart from one another by equal intervals are provided in the flat plate. The guide sections have faces extending approximately in the direction of the longitudinal axis of the valve, which are distributed uniformly over the circumference of the guide sections and give the guide sections the shape of pentagons, so that the equality of distribution of the ejected fuel mass at the fuel injection cone is improved and the static flowthrough quantity is less dependent on the angular position of the valve needle. The number of bores on the flat plate is one less than the number of faces on each guide section.

8 Claims, 2 Drawing Sheets

FUEL INJECTION VALVE

This is a continuation of copending application Ser. No. 124,526 filed Nov. 24, 1987 now abandoned.

BACKGROUND OF THE INVENTION

The invention is based on a fuel injection valve for an internal combustion engine. Fuel injection valves are already known in which the valve needle is guided in the nozzle body by two spaced-apart guide sections of the valve needle. Both these guide sections are embodied as squares, with rounded corners that serve to guide the valve needle in the nozzle body. It has been found that the fuel ejected by the fuel injection valve into the air intake tube forms an injection cone, the shape of which is affected by the more or less parallel guidance of the valve needle in the nozzle body, and that the fuel cone has a higher fuel concentration in the projection of the faces of the squares than in the projection of the corners of the squares. Because of the embodiment of the guide sections of the valve needle as squares and as a consequence of undesirable tilting of the valve needle relative to the longitudinal axis, not only do changes occur in the static flowthrough quantity when the fuel injection valve is opened, as a function of the angular position of the valve needle, but also there is an undesirable unequal distribution of the fuel along the ejected fuel cone, resulting in an unequal distribution of fuel to various cylinders of the engine, when the fuel injection valve supplies various engine cylinders with fuel. The undesirable influence of the angular position of the valve needle on the static flowthrough quantity of the fuel injection valve and the unequal distribution of the ejected fuel are still further reinforced if in addition to the guide sections embodied as squares, a thin lamina having four bores is provided downstream of the valve seat, because the valve needle is capable of rotation about its longitudinal axis and as a result, fuel flowing via the faces of the squares can either meet a bore in the lamina or can be carried from the surface of the lamina to the bores, depending on the rotational position of the valve needle.

OBJECT AND SUMMARY OF THE INVENTION

The fuel injection valve according to the invention has the advantage over this prior art that the influence of the angular position of the valve needle on the static flowthrough quantity of the fuel injection valve and on the equality of distribution of the injected fuel is quite sharply reduced.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
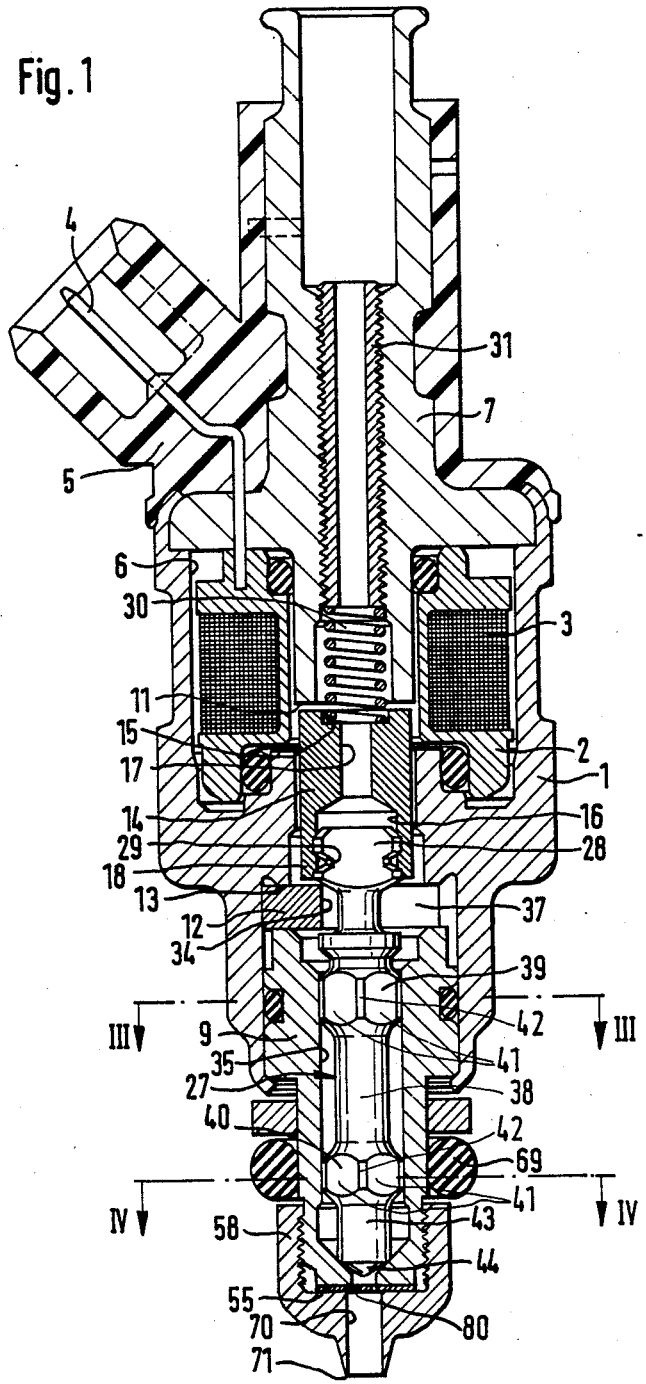
FIG. 1 shows a fuel injection valve embodied according to the invention.

The fuel injection valve shown in FIG. 1 by way of example, for a fuel injection system of a mixture compressing internal combustion engine having externally supplied ignition, has a valve housing 1 of ferromagnetic material, in which a magnet coil 3 is disposed on a coil holder 2. The magnet coil 3 has a current input via a plug connection 4, which is embedded in a plastic ring 5 partially surrounding the valve housing 1.

The coil holder 2 of the magnet coil 3 is seated in a coil chamber 6 of the valve housing 1 which is enclosed by a connector 7 supplying the fuel, which for example is gasoline. The connector 7 protrudes partway into the valve housing 1. Remote from the fuel connector 7, the valve housing 1 surrounds an end portion of a nozzle body 9.

A cylindrical armature 14 is positioned between an end face 11 of the connector 7 and a stop plate 12, which is mounted on an inner shoulder 13 of the valve housing 1 and has a specific thickness for the sake of accurate adjustment of the valve. The armature 14 is made of some magnetic material that is not vulnerable to corrosion and is located coaxially in the valve housing 1, spaced slightly apart from a magnetically conductive step of the valve housing 1, thereby forming an annular air gap between the armature 14 and the step. Beginning at its two end faces, the cylindrical armature 14 is provided with a first and a second coaxial blind bore 15, 16, the second blind bore 16 opening toward the nozzle body 9. The first and second blind bores 15, 16, communicate with one another through a coaxial opening 17. The diameter of the opening 17 is smaller than the diameter of the second blind bore 16. The end section of the armature 14 toward the nozzle body 9 is embodied as a deformation zone 18. This deformation zone 18 has the task of joining the armature 14 in a form-locking manner with a valve needle 27 by grippingly engaging a retention body 28 that forms part of the valve needle 27 and protrudes into the second blind bore 16. The gripping engagement of the retention body 28 by the deformation zone 18 of the armature is attained by the entry under pressure, into grooves 29 located on the retention body 28, of the material comprising the deformation zone 18.

A compression spring 30 rests with one end on the bottom of the first coaxial blind bore 15, and on its other end it rests on a tube insert 31 secured by screwing or wedging in the connector 7. The spring 30 tends to act upon the armature 14 and valve needle 27 with a force oriented away from the connector 7.

With radial clearance, the valve needle 27 penetrates a through bore 34 in the stop plate 12 and is guided with slight radial clearance in a guide bore 35 of the nozzle body 9. The stop plate 12, includes a recess 37 that leads from the through bore 34 to the circumference of the stop plate 12, with the inside diameter of the recess 37 being greater than the diameter of the valve needle 27 in its region surrounded by the stop plate 12.

By means of a connecting section 38 having a smaller diameter, the valve needle 27 has two guide sections 39 and 40, which are axially separated from one another and both guide the valve needle 27 in the guide bore 35 and leave free an axial passageway for the fuel. The second guide section 39 is oriented toward the stop plate 12, while the first guide section 40 is located downstream of the second guide section 39. The first and second guide sections 39, 40 are formed from cylindrical sections from which flat faces 41 are formed embodied in accordance with the invention as pentagons, the flat faces 41 of which, distributed equally over the perimeter, extend approximately parallel to the longitudinal axis of the valve needle and the rounded corners 42 formed between the flat faces 41 guide the valve needle 27 in the guide bore 35. The fuel supplied by the connector 7 can flow past the guide sections 39, 40, via the flow cross sections formed between the faces 41 and the guide bore 35.

A cylindrical section 43 of smaller diameter adjoins the first guide section 40 and is in turn adjoined by a tapering, conical end section 44 which forms a valve sealing seat 47 on a conical valve seat face 48.

Figure 2:
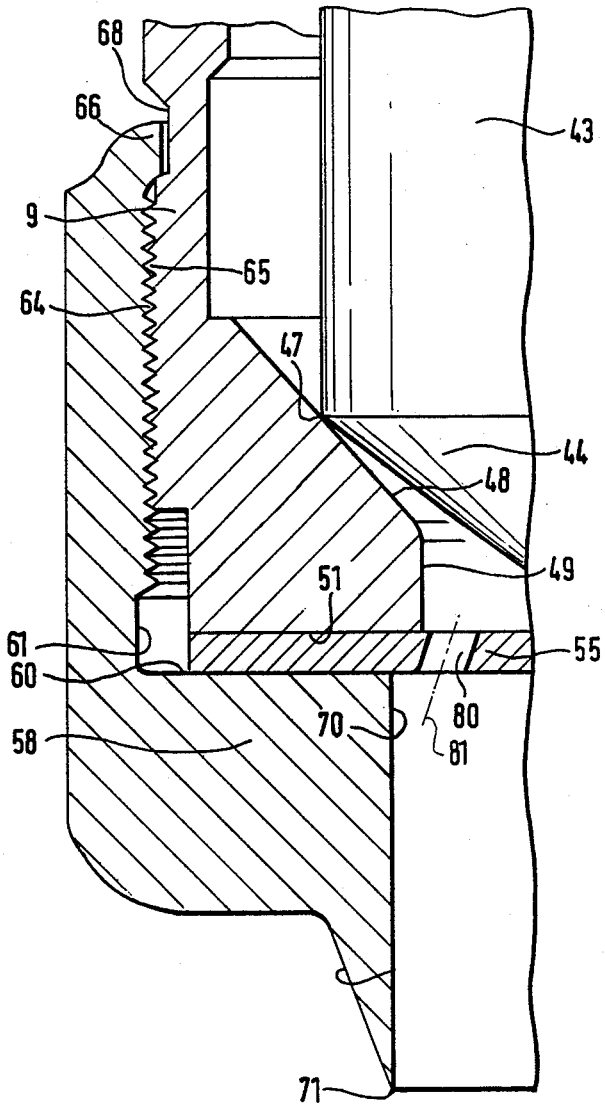
FIG. 2 is a detail of the fuel injection valve of FIG. 1, shown on a different scale.

In FIG. 2, which is a detail of FIG. 1, it can be seen that the transition between the cylindrical section 43 and the conical section 44 forms a sealing seat 47, which in cooperation with a conical valve seat face 48 machined on the nozzle body 9 effects an opening or closing of the fuel injection valve. The conical valve seat face 48 of the nozzle body 9 is continued in the direction remote from the armature 14 in the form of a cylindrical nozzle body opening 49. The end of the nozzle body 9 in the direction remote from the armature 14 is embodied as a flat side 51, which is interrupted by the orifice of the nozzle body opening 49.

Resting on the flat side 51 of the nozzle body 9 is a flat plate 55. The fastening of the flat plate 55 on the flat side 51 is assured by means of a preparation sleeve 58 which is screw threaded onto the nozzle body 9. The plate 55 is braced in between a bottom 60 of a blind bore 61 of the preparation sheath 58 and the flat side 51 of the nozzle body 9.

The flat plate 55 is braced between the nozzle body 9 and the preparation sheath 58 by screwing the preparation sheath 58, with an internal thread 64, onto an external thread 65 machined into the circumference of the nozzle body 9. In order to secure the position of the preparation sheath relative to the nozzle body 9 once it has been screwed in place, the preparation sheath 58 can be wedged in an external groove 68 of the nozzle holder 9 by means of a wedging protrusion 66. The rim of the preparation sheath 58 oriented toward the armature 14 is used as the wedging protrusion 66. For wedging, this element is bent inward into the external groove 68 of the nozzle body 9. Extending between the rim that forms the wedging protrusion 66 and the bottom 60 of the preparation sheath 58 is the jacket face of the blind bore 61, which is embodied over nearly its entire length by the internal thread 64. As shown in FIG. 1, the preparation sheath 58 can simultaneously serve to axially secure a sealing ring 69 that radially encompasses the nozzle body 9 as shown in FIG. 1.

A preparation bore 70 of preferably cylindrical cross section discharges at one end coaxially in the bottom 60 of the preparation sheath 58 and at the other end it discharges in a sharp preparation edge 71.

Located in the flat plate 55 are a plurality of bores 80, which lead from upstream to downstream of the flat plate 55. The bores 80 begin upstream of the flat plate 55, in the nozzle body opening 49 and open into the area bounded by the preparation bore 70 to eject fuel into the preparation bore. With respect to the longitudinal axis of the fuel injection valve, the center axis 81 of the bores 80 has both a radial and a tangential component.

The function of the fuel injection valve is as follows:

When electric current flows through the magnet coil 3, the armature 14 is drawn in the direction toward the connector 7. The valve needle 27, firmly joined to the armature 14, rises with its sealing seat 47 from the conical valve seat face 48, and between the sealing seat 47 and the conical valve seat face 48 a flow cross section is opened up, and the fuel can reach the bores 80 via the nozzle body opening 49. The bores 80 experience a flow through them of fuel at a high pressure drop, since these bores form the narrowest flow cross section inside the fuel injection valve. The size of the bores 80 accordingly decides the flow quantity of the ejected fuel; to one skilled in the art, this is known as "metering". The fuel stream emerging from the bores 80 is aimed at the wall of preparation bore 70. The speed of impact is great enough that the term "collision" can be used. Because of the high kinetic energy upon meeting the wall of the preparation bore 70, the individual fuel droplets are torn open and atomized. The result of this is that downstream of the preparation edge 71, a fuel mist of conical shape emerges from the fuel injection valve. This fuel mist allows good mixing with the air aspirated by the engine.

Very good fuel preparation is attained with the fuel injection valve. The best results are obtained, assuming the flat plate 55 has a thickness of 0.3 mm, if the diameter of the preparation bore 70 is 2.2 mm and its length is 5 mm. The diameter of the bores 80 is dependent on the particular application and is in the range between 0.15 and 0.35 mm.

The bores 80 are disposed in the flat plate 55 spaced apart by equal intervals from one another. In known fuel injection valves of this type, the first and second guide sections 39, 40 are embodied as squares. In that case there is an undesirable dependency of the static flowthrough fuel quantity on the angular position of the valve needle and an unequal distribution of the mass of the injected fuel at the fuel injection cone. According to the invention, and as shown in section in FIGS. 3 and 4, the first and second guide section 39, 40 now each have one more face, 41, than there are bores 80 provided in the flat plate 55. In the exemplary embodiment shown, there are four bores 80 provided in the flat plate 55, so that according to the invention the first and second guide sections 39, 40 are embodied as pentagons. By embodying the guide sections 39, 40 as pentagons, not only does more uniform distribution of the mass of the ejected fuel take place, but there is also better axial guidance of the valve needle 27 in the nozzle body 9, so that the tendency of the valve needle 27 to tilt is reduced, which promotes a uniform distribution of mass over the ejected fuel cone.

Figure 3:
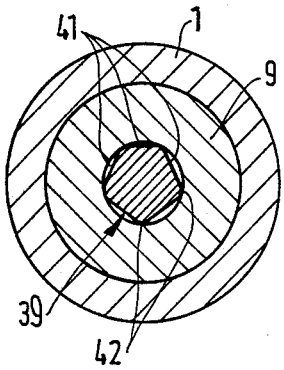
FIG. 3 is a section taken along the line III—III of FIG. 1.
Figure 4:
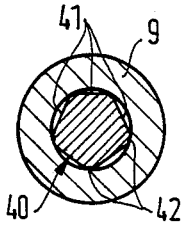
FIG. 4 is a section taken along the line IV—IV of FIG. 1.

The advantages discussed herein are attained not only for a fuel injection valve that has a flat plate 55 with bores 80 located downstream of the valve seat face 48, but also in a fuel injection valve not having a flat plate 55 and not having a preparation sheath 58. An improvement in the equality of distribution of the ejected fuel and in the static flowthrough quantity is thus obtained in any fuel injection valve the valve needle 27 of which has a first guide section 40 and a second guide section 39, the first and second guide sections 39, 40 each being embodied as a pentagon with rounded corners in between the flat faces that form the pentagon as shown in FIGS. 3 and 4.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection valve for fuel injection systems of internal combustion engines, comprising a nozzle holder, said nozzle holder having a valve seat face, a valve needle having a longitudinal axis and a sealing section cooperating with said valve seat face, said valve needle including a first guide section upstream of said sealing section and a second guide section upstream of said first guide section, said first and second guide sections each having a plurality of flat faces separated by rounded corners distributed uniformly over their perimeter in which said flat faces are approximately parallel to the longitudinal axis of said valve needle, said first and second guide sections are arranged to guide said valve needle in a guide bore, a flat plate (55) secured across a lower end of said nozzle holder (9), said flat plate including a plurality of equally spaced fuel metering bores (80) therein, and the number of flat faces formed on said first guide section (40) is greater by one than the number of fuel metering bores (80) in said flat plate (55).

2. A fuel injection valve as defined by claim 1, in which the number of flat faces (41) formed on the second guide section (39) is greater by one than the number of fuel metering bores (80) in the flat plate.

3. A fuel injection valve as set forth in claim 2, in which each of said bores (80) has an axis which has both a radial and a tangential component with respect to the axis of the fuel injection valve.

4. A fuel injection valve as set forth in claim 3, in which said flat plate has a thickness of about 0.3 mm and each of the fuel metering bores (80) have a diameter from about 0.15 to about 0.35 mm.

5. A fuel injection valve as set forth in claim 2, in which said flat plate has a thickness of about 0.3 mm and each of the fuel metering bores (80) have a diameter from about 0.15 to about 0.35 mm.

6. A fuel injection valve as set forth in claim 1, in which each of said fuel metering bores (80) have an axis which has both a radial and a tangential component with respect to the axis of the fuel injection valve.

7. A fuel injection valve as set forth in claim 6, in which said flat plate has a thickness of about 0.3 mm and each of the fuel metering bores (80) have a diameter from about 0.15 to about 0.35 mm.

8. A fuel injection valve as set forth in claim 1, in which said flat plate has a thickness of about 0.3 mm and each of the fuel metering bores (80) have a diameter from about 0.15 to about 0.35 mm.

* * * * *